US007937771B2

(12) United States Patent
Mazzarolo

(10) Patent No.: US 7,937,771 B2
(45) Date of Patent: May 10, 2011

(54) GARMENT FOR MOTORCYCLISTS WITH IMPROVED COMFORT

(75) Inventor: Gabriele Mazzarolo, Treviso (IT)

(73) Assignee: Alpinestars Research SRL, Coste Di Maser, Treviso (IT)

( * ) Notice: Subject to any disclaimer, the term of this patent is extended or adjusted under 35 U.S.C. 154(b) by 0 days.

(21) Appl. No.: 11/116,126

(22) Filed: Apr. 27, 2005

(65) Prior Publication Data

US 2005/0210559 A1 Sep. 29, 2005

Related U.S. Application Data

(63) Continuation of application No. PCT/EP03/11991, filed on Oct. 29, 2003.

(30) Foreign Application Priority Data

Oct. 31, 2002 (IT) ..... TV20020047 U

(51) Int. Cl.
*A41D 13/00* (2006.01)

(52) U.S. Cl. ..... 2/69; 2/456

(58) Field of Classification Search ..... 2/69, 79, 2/227, 237, 456, 115, 71, 72, 2.15–2.17, 2/94, 22, 23; 482/105; 428/105
See application file for complete search history.

(56) References Cited

U.S. PATENT DOCUMENTS 1,660,342 A 2/1928 Levinson
2,280,479 A * 4/1942 Coben ..... 2/76
2,554,380 A * 5/1951 Olrich et al. ..... 2/90
3,037,210 A * 6/1962 Neuman ..... 2/125
3,086,214 A * 4/1963 Lash ..... 2/79
3,329,966 A 7/1967 Slavick
3,654,632 A * 4/1972 Lacroix ..... 2/125
3,843,969 A 10/1974 George et al.
3,878,561 A 4/1975 Winiecki
4,608,716 A * 9/1986 Brumfield ..... 2/2.5
4,700,407 A 10/1987 Mattila
4,722,099 A 2/1988 Kratz
4,773,100 A 9/1988 Kuo
4,810,559 A 3/1989 Fortier et al.
4,841,577 A * 6/1989 Lars-Jos ..... 2/16
4,845,778 A 7/1989 Peterson
4,946,453 A * 8/1990 Monson ..... 604/312

(Continued)

FOREIGN PATENT DOCUMENTS

DE 37 31 878 1/1989

(Continued)

OTHER PUBLICATIONS

Japanese Office Action dated Aug. 28, 2009, from the corresponding Japanese Application.

(Continued)

*Primary Examiner* — Alissa L Hoey
(74) *Attorney, Agent, or Firm* — Katten Muchin Rosenman LLP

(57) ABSTRACT

Elastic inserts (15, 25) are incorporated in selected zones such as the legs and arms of an article of garment for motorcyclists, for example a leather suit, said inserts having a shape and manner of application such that the configuration of the garment in the rest condition corresponds to the position of the person wearing the garment when riding a motorcycle, but also allows said person to move freely when not sat in the saddle of the motorcycle.

4 Claims, 6 Drawing Sheets

U.S. PATENT DOCUMENTS

| | | | | | |
|---|---|---|---|---|---|
| 4,953,856 | A | * | 9/1990 | Fox, III | 482/105 |
| 5,038,408 | A | | 8/1991 | Debaene | |
| 5,052,052 | A | | 10/1991 | Gilford et al. | |
| 5,109,546 | A | * | 5/1992 | Dicker | 2/70 |
| 5,201,074 | A | * | 4/1993 | Dicker | 2/70 |
| 5,282,277 | A | * | 2/1994 | Onozawa | 2/69 |
| 5,295,267 | A | | 3/1994 | Galindo | |
| 5,337,418 | A | * | 8/1994 | Kato et al. | 2/456 |
| 5,367,708 | A | * | 11/1994 | Fujimoto | 2/22 |
| 5,410,759 | A | * | 5/1995 | Hari | 2/108 |
| 5,608,913 | A | * | 3/1997 | Lacoste | 2/115 |
| 5,649,328 | A | | 7/1997 | Martin | |
| 5,652,957 | A | | 8/1997 | Williford et al. | |
| 5,737,772 | A | * | 4/1998 | Dicker et al. | 2/69 |
| 5,737,773 | A | * | 4/1998 | Dicker et al. | 2/69 |
| 5,768,703 | A | * | 6/1998 | Machado et al. | 2/2.15 |
| 5,845,335 | A | | 12/1998 | Twitty | |
| 5,845,336 | A | | 12/1998 | Golde | |
| 5,898,934 | A | * | 5/1999 | Hunter et al. | 2/2.15 |
| 5,960,474 | A | * | 10/1999 | Dicker et al. | 2/69 |
| 5,978,966 | A | * | 11/1999 | Dicker et al. | 2/69 |
| 6,053,852 | A | * | 4/2000 | Wilkinson | 482/127 |
| 6,176,816 | B1 | * | 1/2001 | Dicker et al. | 482/124 |
| 6,186,970 | B1 | * | 2/2001 | Fujii et al. | 602/75 |
| 6,260,196 | B1 | | 7/2001 | van der Sleesen | |
| 6,279,161 | B1 | * | 8/2001 | Johnston | 2/69 |
| 6,519,781 | B1 | * | 2/2003 | Berns | 2/267 |
| D481,523 | S | * | 11/2003 | Hujii et al. | D2/742 |
| 6,671,884 | B1 | * | 1/2004 | Griesbach, III et al. | 2/69 |
| 6,708,342 | B2 | | 3/2004 | Boersema | |
| 6,817,029 | B2 | * | 11/2004 | Mazzarolo | 2/22 |
| 7,117,537 | B2 | * | 10/2006 | Mazzarolo | 2/69 |
| 7,229,390 | B2 | * | 6/2007 | Fujii et al. | 482/124 |
| 7,516,498 | B2 | * | 4/2009 | Torry | 2/69 |
| 2001/0014981 | A1 | * | 8/2001 | Fairhurst et al. | 2/69 |
| 2002/0138893 | A1 | * | 10/2002 | Culhane | 2/79 |
| 2003/0140404 | A1 | | 7/2003 | Golde | |
| 2004/0025217 | A1 | * | 2/2004 | Mazzarolo | 2/69 |
| 2004/0255358 | A1 | * | 12/2004 | Ota et al. | 2/69 |
| 2005/0229283 | A1 | * | 10/2005 | Towle et al. | 2/93 |

FOREIGN PATENT DOCUMENTS

| | | | | |
|---|---|---|---|---|
| DE | 39 00 694 | | | 7/1990 |
| DE | 41 42 279 | | | 11/1992 |
| DE | 195 27 037 | | | 1/1997 |
| DE | 199 20 562 | | | 11/2000 |
| DE | 100 17 792 | | | 10/2001 |
| EP | 0 118 898 | | | 9/1984 |
| EP | 0 950 360 | | | 10/1999 |
| FR | 2449415 | A | * | 10/1980 |
| FR | 2476453 | | | 8/1981 |
| FR | 2476453 | A | * | 8/1981 |
| FR | 2665060 | A1 | * | 1/1992 |
| GB | 171528 | | | 11/1921 |
| JP | 60-82411 | | | 6/1985 |
| JP | 5-81209 | | | 11/1993 |
| JP | 3020113 | | | 10/1995 |
| JP | 11-323633 | | | 11/1999 |
| WO | WO 01/10254 | | | 2/2001 |

OTHER PUBLICATIONS

United States Office Action dated Dec. 1, 2004, from corresponding U.S. Appl. No. 10/399,347.

United States Office Action dated May 18, 2005, from corresponding U.S. Appl. No. 10/399,347.

United States Office Action dated Feb. 22, 2006, from corresponding U.S. Appl. No. 10/399,347.

United States Office Action dated Feb. 23, 2004, from corresponding U.S. Appl. No. 10/415,624.

International Search Report dated Sep. 9, 2005, from corresponding International Application No. PCT/EP2004/013095.

Written Opinion of the International Searching Authority, from corresponding International Application No. PCT/EP2004/013095.

International Search Report dated Mar. 12, 2004.

International Preliminary Examination Report dated Jan. 17, 2005.

* cited by examiner

GARMENT FOR MOTORCYCLISTS WITH IMPROVED COMFORT

CROSS-REFERENCE TO RELATED APPLICATION

This application is a continuation of International Application PCT/EP2003/011991 filed on Oct. 29, 2003, now International Publication Number WO 2004/039189 published on May 13, 2004 and claims priority from Italian Patent Application TV2002U000047 filed on Oct. 31, 2002, the contents of which are herein wholly incorporated by reference.

BACKGROUND OF THE INVENTION

1. Field of the Invention

The present invention relates to the garment used by motorcyclists, more particularly not only the suits where a pair of trousers is inseparably joined to a body-piece, but also the body-pieces or jackets and the trousers on their own.

2. Description of Related Art

These articles of garment are usually made of leather and are characterized by somewhat ill-matched conditions of use. The first condition of use relates to the motorcycle riding, so that the garment must adhere to the body of the person wearing it, not only to avoid undesirable aerodynamic effects, but also so as not to obstruct movements, especially although not exclusively during sports competitions. The second condition of use relates to the person when not sitting in the saddle of the motorcycle, so that the garment must allow the wearer to walk and more generally to perform free movement of the upper and lower limbs. In most cases the manufacturers tend to make the garment in question in such a way as to favour this second condition of use, to the detriment of the first condition, which is a penalizing factor and a cause of dissatisfaction for many users.

A design which to a certain extent attempts to overcome these shortcomings is the leather suit disclosed in European patent application EP-A-0 950 360 which envisages the application of a number of elastic inserts on the visible surface thereof. The only one of these inserts which is described and illustrated in full in the said document is an elastic strip in the form of a "U" consisting of three parts applied respectively on the two sides of the trunk, where the folds present in the insert are substantially vertical in the rest condition (i.e. when the suit is not being worn), and on the bottom of the back, where the corresponding folds are substantially horizontal. In this way the direction of greatest elasticity of the various parts of the U-shaped strip is substantially perpendicular to the line of longitudinal development of the said parts. The effectiveness of this elastic insert is, however, limited to the trunk of the body, so that it may be stated that this suit, although it is more satisfactory than others, nevertheless does not possess optimum features for riding a motorcycle. It must be noted, moreover, that the U-shaped strip is obtained by forming separately its three parts and then sewing them together (end to end), after the strip has been applied to the suit and while maintaining it stretched to its maximum extent. This makes manufacture of the suit somewhat complex and therefore also relatively costly. Other inserts which have a linear shape and limited extension are separately applied in other zones of the suit.

SUMMARY OF THE INVENTION

It would desirable and in fact constitutes a main object of the present invention to provide users with a garment which is able to favour the position assumed by the body and the manoeuvres performed when riding motorcycles, also in the case of use for sports competitions, but without limiting the freedom of movement of the lower and/or the upper limbs when walking and, in any case, when the person wearing the garment is not sat in the saddle of a motorcycle.

A similar object has been considered in WO-A-01 10254 where it is proposed to use an elasticized insert arranged at the abdomen portion of the suit.

BRIEF DESCRIPTION OF THE DRAWINGS

A motorcyclist's suit for achieving this object, together with other objects, has the characteristic features claimed here below, as explained in the following description of a non-exclusive embodiment which refers to the accompanying drawing, where:

FIG. 6A shows the plan view extension of the elastic insert according to the invention which is shown in FIG. 4A, while

DETAILED DESCRIPTION OF THE INVENTION

Figure 3:
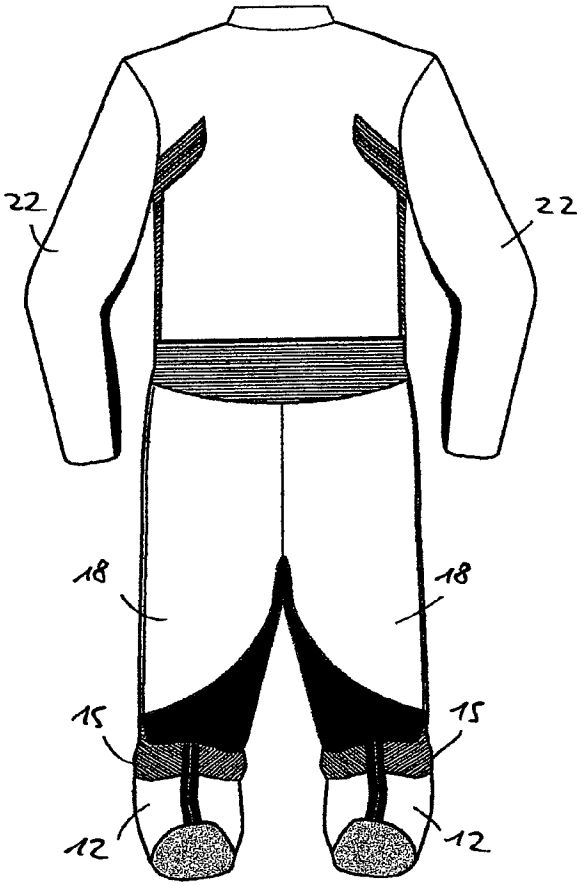
FIG. 3 shows the view, from the rear, of the suit according FIG. 1.
Figure 2:
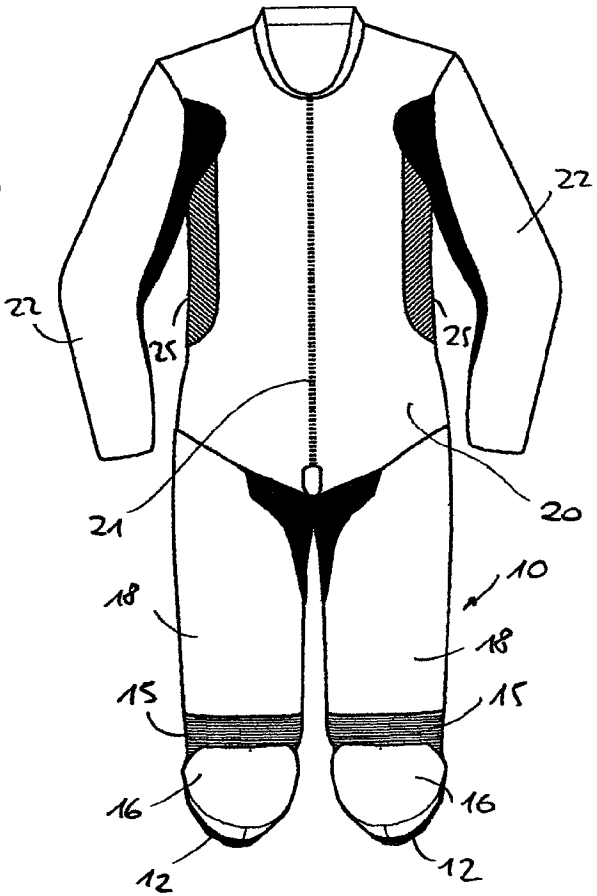
FIG. 2 shows the view from the front.
Figure 1:
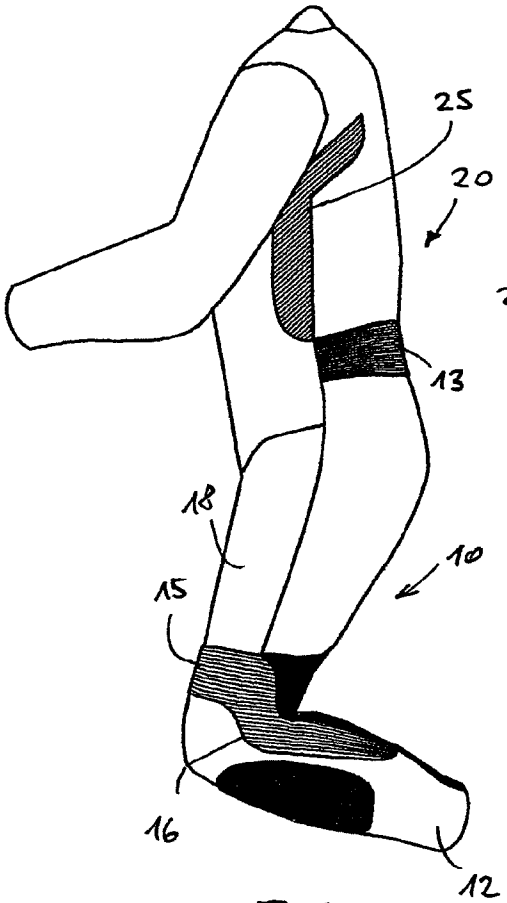
FIG. 1 shows the view, from the outer side, of a motorcyclist's suit according to the invention, where the trousers are shown in the configuration assumed in the rest condition, namely when the suit is not worn by a person.

As shown in FIGS. 1-3, the suit is a garment where a pair of trousers 10 and a body-piece 20, which are preferably made of leather, are inseparably joined together, with a conventional elastic insert 13 limited to the bottom of the back. Various zip fasteners are provided, in particular that indicated by 21, along the vertical middle axis of the body-piece 20, on the front of the latter, and those (not shown for the sake of simplicity) at the bottom ends of the calves 12 and the sleeves 22.

According to the invention, elastic inserts are incorporated in the suit and joined by means of perimetral stitches (for the sake of simplicity not shown) to the adjacent parts of the suit. The ring-shaped inserts 15 form part of the legs of the pair of trousers 10, while the inserts 25 in the form of an overturned "L" form part of the body-piece 20. All the said inserts are made using a technique which is well-known to specialists in the sector, namely by joining a layer of very thin elastic fabric to a layer of leather—and if necessary also to an intermediate layer of reinforced fabric: a series of closely arranged transverse stitches S are performed when the layer of very thin elastic fabric is fully tensioned with the result that a plurality of folds F are created when the suit is in rest condition.

The ring-shaped inserts 15 which form part of the pairs of trousers 10 extend in fact continuously on either side of the knees 16, namely the articulation between the thighs 18 and the calves 12. Each of these inserts comprises in fact—as can be seen from their plan view extension shown in FIG. 6A: a central strip 152 designed to be arranged at the bottom of the thighs 18 above the knee 16; two connecting parts 154 which are designed to extend along the sides of the calf 12; two tapered wings 156 which extend further downwards and backwards along the calf until the respective end edges are located closely to one another. In this way the configuration assumed by a suit according to the invention in the rest conditions (which are those shown in FIGS. 1 to 4A) is such that the angle formed by the axis of each calf 12 with the axis of the respective thigh 18 is between 80 and 100 degrees and preferably about 90 degrees—see FIG. 5B. If it is considered that the angle formed by the axis of each calf 12 with the axis of the respective thigh 18 in the most common riding condition, namely non-competitive riding, of a motorcycle is precisely between 80 and 100 degrees, and preferably about 90 degrees, the present invention offers ergonomic characteristics such as to fully satisfy the requirements of the wearer during the first of the abovementioned conditions of use. In this configuration the inserts 15 have a plurality of folds F which are spaced by grooves and are more or less equidistant, as can be seen particularly well in FIGS. 4A and 5B.

Figures 5A, 5B, 5C, 5D:
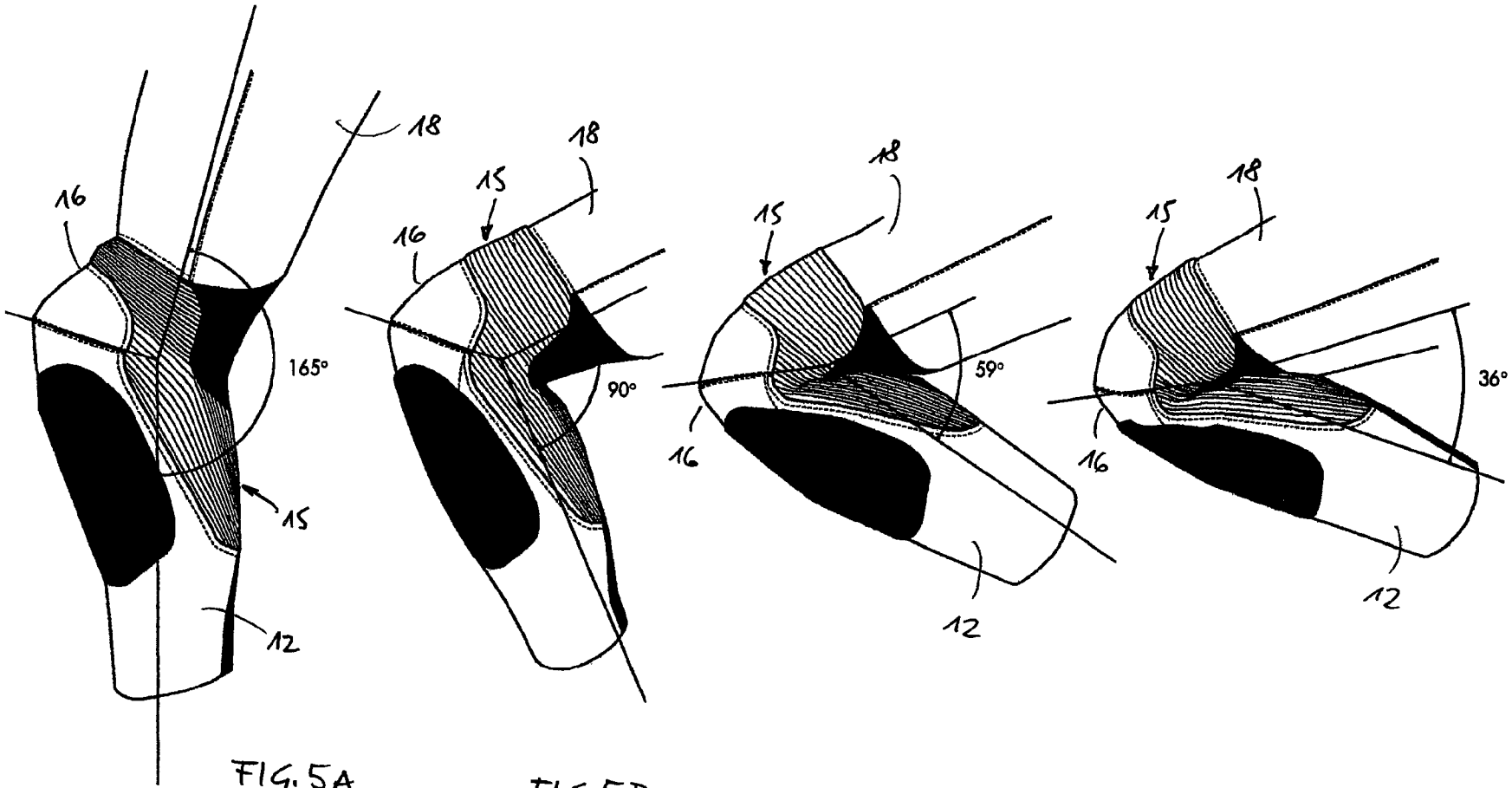
FIGS. 5A, 5B, 5C and 5D show—from the same angle as in the preceding figures—four different configurations assumed by the legs of the trousers of a suit according to the invention in different conditions of use.
Figure 6A:
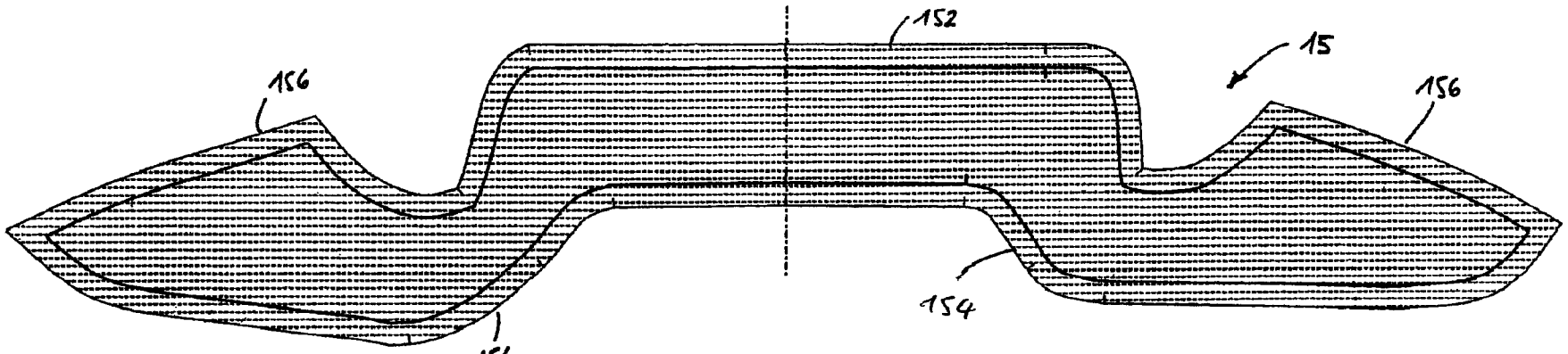
Figure 6B:
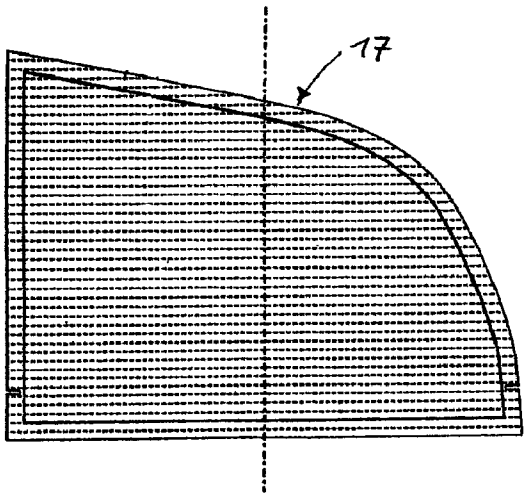
FIG. 6B shows the plan view extension of the example of the conventional elastic insert shown in FIG. 4B.

Moreover, this does not adversely affect in any way other conditions of use of the suit, as shown:

- in FIG. 5A, relating to the walking—or in any case erect—position of the person wearing the suit, where the abovementioned angle is close to 180 degrees, for example 165 degrees;
- in FIG. 5C, relating to a first condition of competitive riding of the motorcycle, where the abovementioned angle is about 60 degrees; and
- in FIG. 5D, relating to a second condition of competitive riding of the motorcycle, where the abovementioned angle is even less than 45 degrees, for example 36 degrees.

As is clear when comparing FIG. 5B with FIG. 5A, the folds F of the insert 15 are more compact above the knee 16 and more spaced out along the calf 12, while in FIGS. 5C and 5D the folds F of the insert are more spaced out above the knee 16 and more or less compact along the calf 12.

Figure 7:
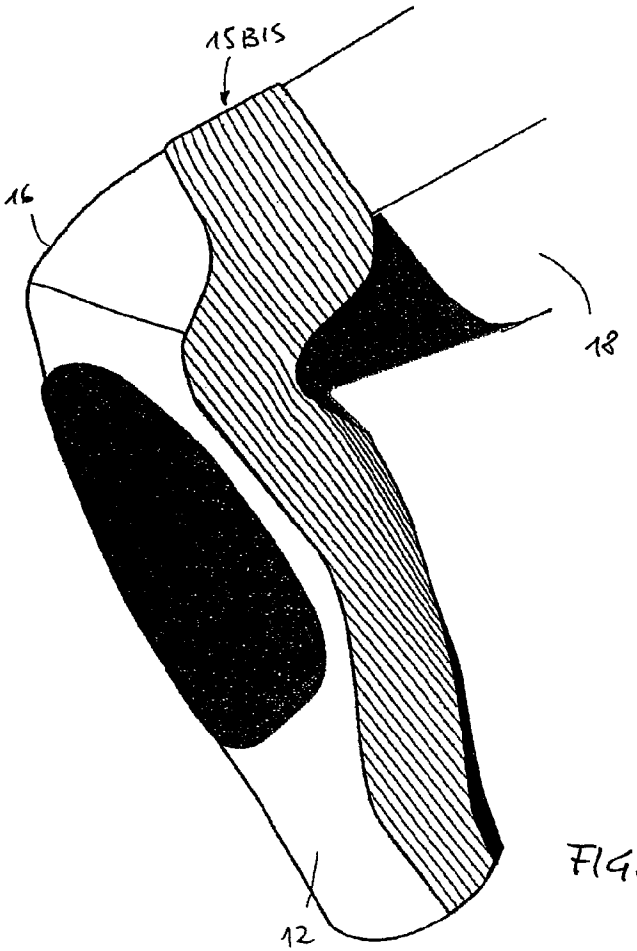
FIG. 7 is similar to FIG. 4A and shows a variant of an elastic insert applied to the trousers of a suit according to the invention.

FIG. 7 is a variant of the invention where the tapered wings 156*b* of the insert 15 extend as far as the bottom end of the trousers 10 of the suit, practically as far as the zone in the immediate vicinity of the heel.

Other variations envisage the incorporation of ring-shaped elastic inserts in the sleeves 22 of the body-piece 20 of the suit and on either side of the elbows, namely the articulation between the arms and forearms, so that the configuration of the body-piece in the rest condition of the suit is more or less the same as that already described for the trousers and also corresponds to the most frequent riding condition of the motorcycle.

Figure 4B:
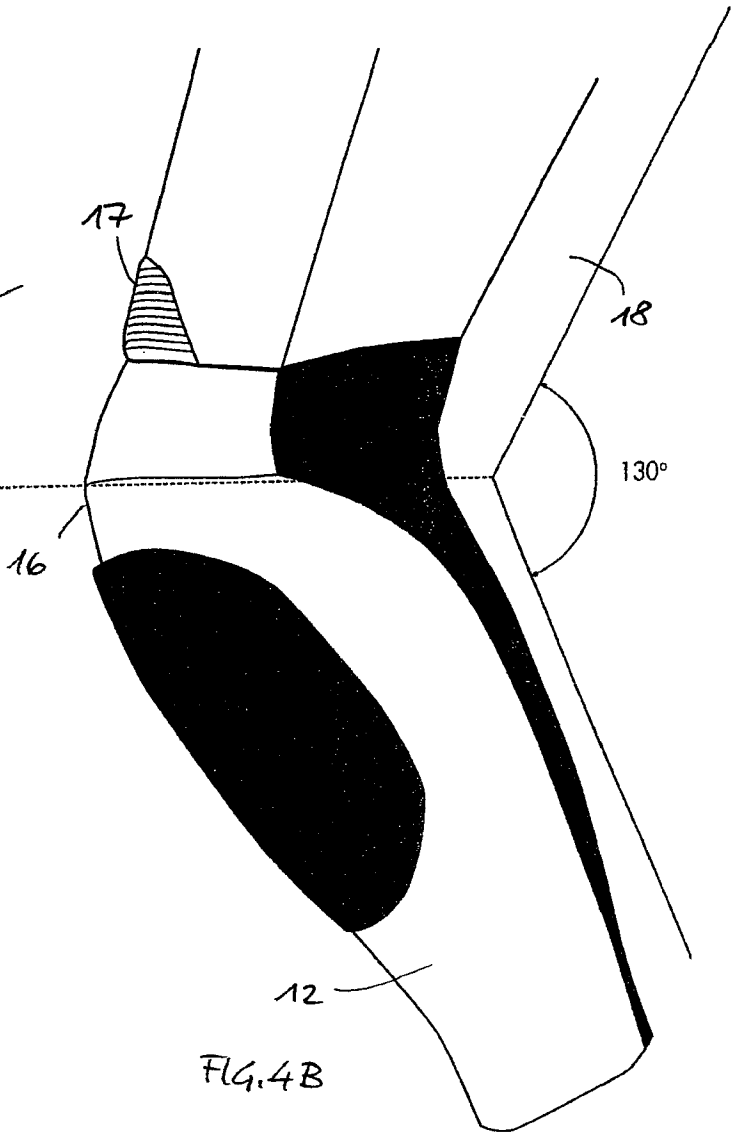
FIGS. 4A and 4B show a view, from the outer side, of respectively a part of the trousers alone of a suit according to the invention and of an example of a conventional suit so as to allow easy comparison of the configurations assumed by the two suits in the rest condition.
Figure 4A:
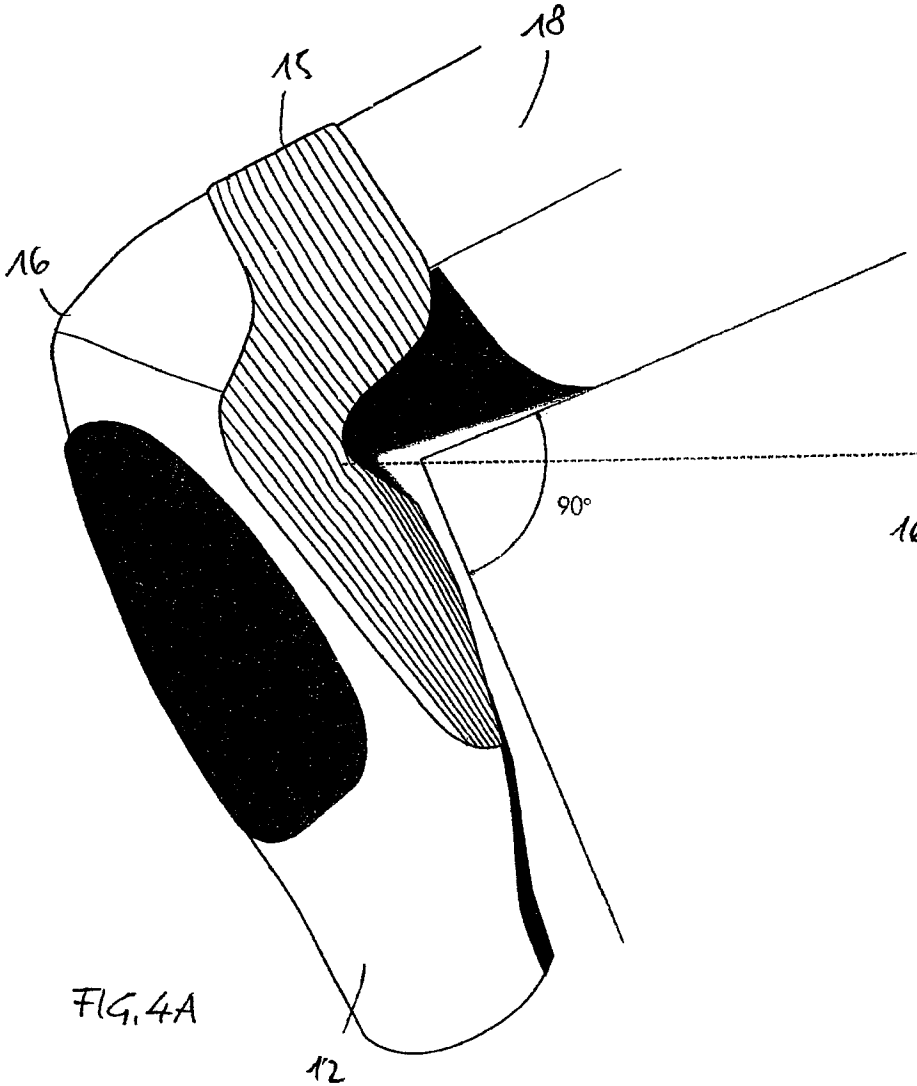

In the suits of conventional design, the inserts applied above the knees (as for example indicated by the reference number 17 in FIG. 4B) generally have a limited extension and in any case do not extend on either side of the knees, but only above them. As shown in FIG. 4B, the angle formed by the axis of each calf 12 with the axis of the respective thigh 18 is about 130 degrees, namely quite different from the angle assumed in any other position when riding a motorcycle, thereby demonstrating the less ergonomic design of conventional suits which do not satisfy fully the first of the abovementioned conditions of use.

Figure 10:
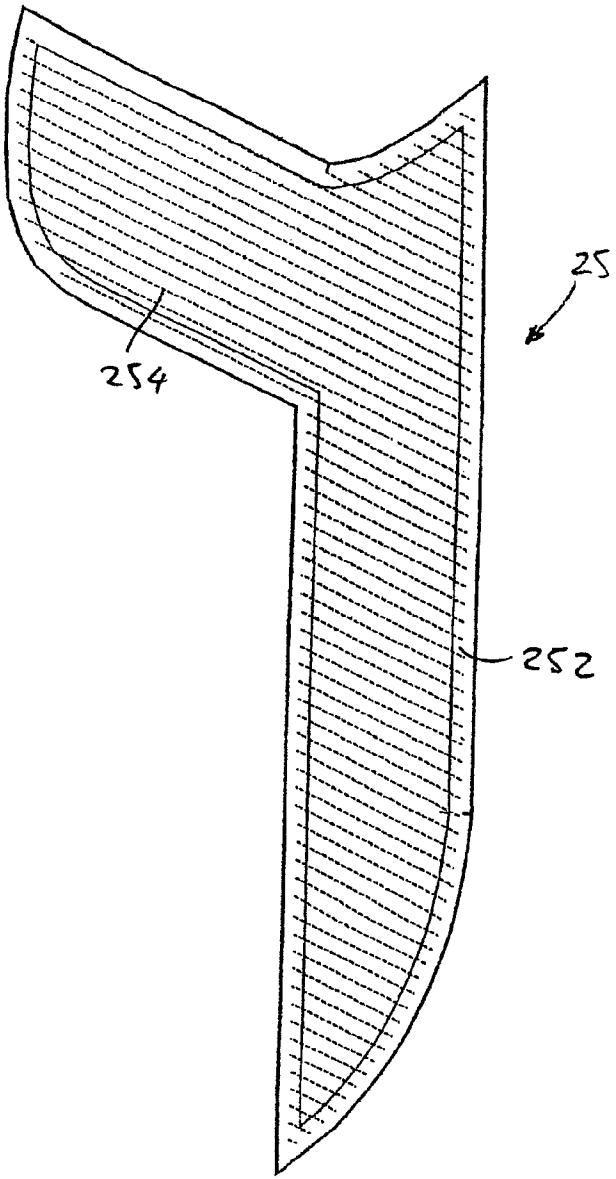
FIG. 10 shows a plan view extension of the elastic insert of the body-piece which is shown in FIGS. 8 and 9.
Figure 9:
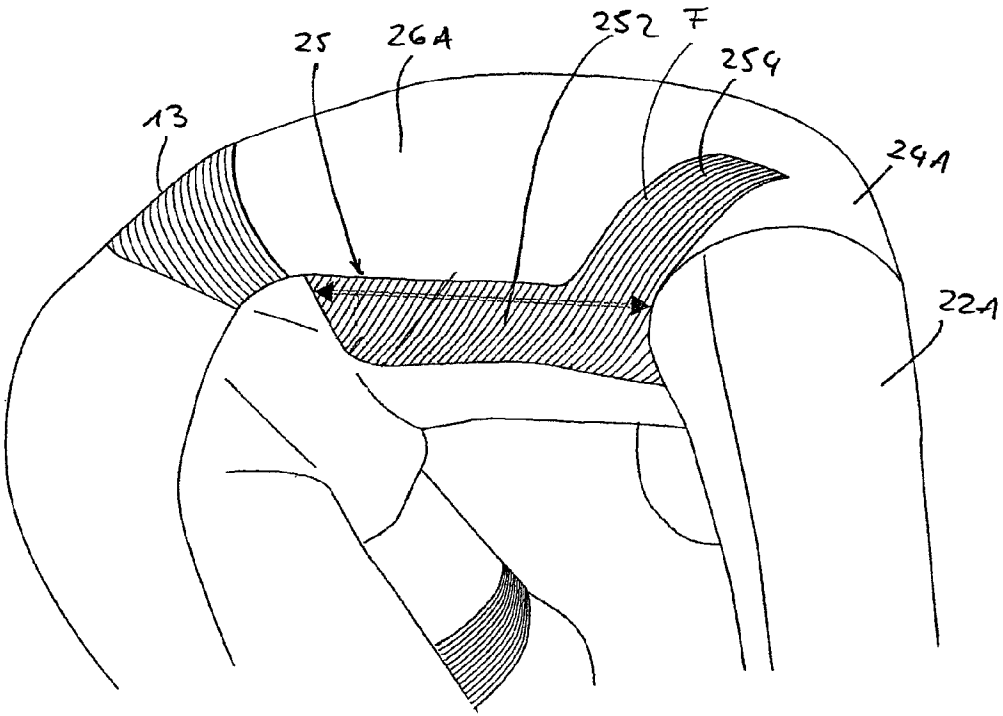
FIG. 9 is similar to FIG. 8, but shows the body-piece in the configuration assumed when the person wearing the suit is riding a motorcycle.
Figure 8:
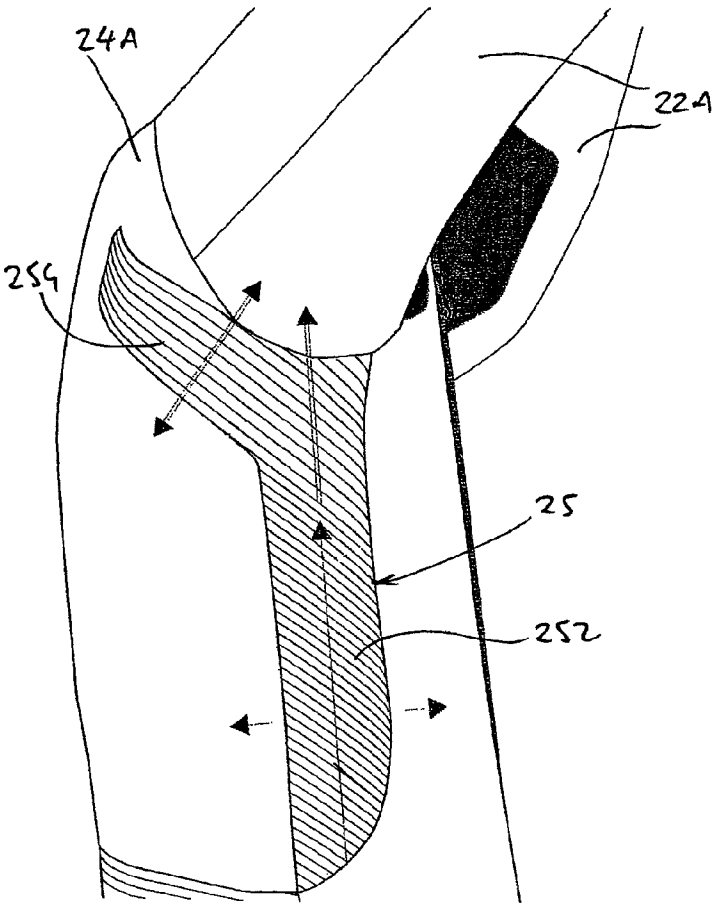
FIG. 8 shows a partial view, from the outer side, of the body-piece according to the invention in the configuration assumed when the person wearing the suit has his/her arms raised.

As shown in FIGS. 8-10, the elastic inserts 25 incorporated in the body-piece 20 of a suit according to the invention have a first side 252 which extends along the sides of the trunk underneath the armpits, and a second side 254 inclined upwards, namely towards the shoulders 24A. Over the whole of the extension of the inserts 25 the folds F assume, a position which is inclined at an angle .alpha. of about 45 degrees with respect to the longitudinal axis T of the body-piece 20 and, in particular; favours raising of the arms 22A—see FIG. 8—and arching of the back 26A—see FIG. 9—during riding of the motorcycle. This is due to the fact that the inserts 25 are able to withstand vertical and horizontal tensile stresses represented by the double pointed arrows in the drawing. As shown in FIGS. 8-10, each insert comprises a plurality of longitudinal folds F that are substantially parallel to each other and uniformly spaced to each other Each of the folds is inclined at an angle of substantially 45 degrees with respect to an axis of the body-piece and extending downwardly from the back toward the front on both the first and second sides; the plurality of folds favors the raising of arms and arching of a back in the common riding position wherein the folds are in such uniformly spaced position, but able to withstand both vertical and horizontal stresses.

Other variations and embodiments may be developed within the scope of protection defined by the appended claims. In particular, it must be pointed out that the object of the invention also includes the trousers on their own and body-piece on its own and not only a suit.

The invention claimed is:

1. A sport suit for a motorcyclist for having an improved wear when one of a knee and an elbow joint is flexed from a common riding position, the suit comprising:

a pair of trousers having legs;

a body-piece having sleeves;

an elastic insert disposed in a respective one of the legs and the sleeves to border a portion of a respective joint, each insert comprising a plurality of longitudinal folds, the longitudinal folds in each insert being substantially parallel to each other and uniformly spaced apart in each respective one of the leg inserts and the sleeve inserts when the motorcyclist is in the common riding position, the suit further comprising a thigh area, a knee area, and calf area, and wherein the elastic leg insert is disposed proximate to the knee and further comprises a central strip disposed at the bottom of a thigh area but above the knee area, the longitudinal folds forming a circle there around with a periphery of the central strip extending perpendicularly to the axis of the leg, two tapered wings having distal edges, the wings disposed behind the calf area so that the distal edges are located closely to one another, the longitudinal folds running axially along the calf area, and two connecting parts disposed inside and on the outside of the calf area between said central strip and the said tapered wings, wherein in a common riding position, the angle formed by an axis of each calf area with an axis of the respective thigh area is between 80 and 100 degrees and the elastic inserts are disposed on the legs in an unstretched condition, and wherein in an erect standing position the folds in the central strip are compressed together and the folds in the wings are expanded, and in a competitive riding position the folds in the central strip are expanded and the folds in the wings are compressed.

2. The sport suit of claim 1, wherein the inserts comprising a shape that does not cover the joint.

3. The sport suit of claim 1, wherein the inserts comprise a ring starting at a front thigh area and proceeding to a calf.

4. A sleeved body-piece for a motorcyclist for having an improved wear, the body-piece having an armpit area, a shoulder area, and a waist area; the body-piece comprising:

a durable material resistant to motorcycle falls while the motorcycle is in motion;

two elastic inserts suitable for keeping the suit adhered to a body of the motorcyclist in a common riding position, each insert comprising an overturned L-shape;

wherein the L shape comprises a first side and a second side, the first side extended from below the shoulder area to the armpit area, and the second side extends from the armpit area to a terminus in the waist area;

wherein the first side and the second side are angled about 45 degrees to each other; and wherein the respective first sides of each insert extend in opposite directions with no points of mutual contact between them;

each insert comprising a plurality of longitudinal folds being substantially parallel to each other and uniformly spaced to each other when in the common riding position, each of the folds being inclined at an angle of substantially 45 degrees with respect to an axis of the body-piece and extending downwardly from the back toward the front on both the first and second sides; the plurality of folds favoring the raising of arms and arching of a back in the common riding position wherein the folds are in such uniformly spaced position, but able to withstand both vertical and horizontal stresses.

* * * * *